US008997858B2

(12) United States Patent
Tom

(10) Patent No.: US 8,997,858 B2
(45) Date of Patent: Apr. 7, 2015

(54) LINER HANGER/PACKER APPARATUS WITH PRESSURE BALANCE FEATURE ON ANCHOR SLIPS TO FACILITATE REMOVAL

(71) Applicant: Baker Hughes Incorporated, Houston, TX (US)

(72) Inventor: Andy Tom, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 168 days.

(21) Appl. No.: 13/740,908

(22) Filed: Jan. 14, 2013

(65) Prior Publication Data

US 2014/0196890 A1 Jul. 17, 2014

(51) Int. Cl.
*E21B 23/00* (2006.01)
*E21B 43/10* (2006.01)

(52) U.S. Cl.
CPC ..... *E21B 43/105* (2013.01)

(58) Field of Classification Search
CPC ..... E21B 43/10; E21B 43/105; E21B 33/129; E21B 33/128; E21B 33/134; E21B 33/12; E21B 33/1204
USPC ..... 166/208, 179, 140, 387, 134, 118
See application file for complete search history.

(56) References Cited

U.S. PATENT DOCUMENTS

| | | | | |
|---|---|---|---|---|
| 7,607,476 | B2 | 10/2009 | Tom et al. | |
| 8,132,619 | B2 | 3/2012 | Smith, Jr. et al. | |
| 2005/0217847 | A1 | 10/2005 | Jones | |
| 2006/0272827 | A1 | 12/2006 | Adam et al. | |
| 2008/0047704 | A1 | 2/2008 | Tom | |
| 2009/0200040 | A1 * | 8/2009 | Smith et al. | 166/380 |
| 2012/0085549 | A1 | 4/2012 | O'Connor et al. | |

* cited by examiner

*Primary Examiner* — Yong-Suk (Philip) Ro
(74) *Attorney, Agent, or Firm* — Steve Rosenblatt

(57) ABSTRACT

A liner hanger/packer apparatus operates by sequential expansion of a slip ring and then a sealing element. The hanger slips are set by pressure on a seated ball actuating anchor slips to grip followed by a stroker assembly and a swage making a first movement. The ball seat is defeated and the liner is cemented. A pickup force extends landing dogs so that a subsequent set down force releases a flapper to close and closes off fluid ports associated with the anchor slips so that pressure on the closed flapper sets the anchor and strokes the swage a second stroke to set the sealing element. A rupture disc breaks in the flapper after further relative movement of mandrel components to open the fluid displacement ports so that the anchor is in pressure balance to backpressure developed from fluid moving through the now broken disc as the running tool is removed.

21 Claims, 12 Drawing Sheets

LINER HANGER/PACKER APPARATUS WITH PRESSURE BALANCE FEATURE ON ANCHOR SLIPS TO FACILITATE REMOVAL

FIELD OF THE INVENTION

The field of the invention is expandable liner hanger/packer tools and more particularly the provision of a feature that precludes anchor slip extension during running tool removal caused by fluid movement through the running tool during removal.

BACKGROUND OF THE INVENTION

The original tool is shown in FIGS. 1*a*-1*c* and 2*a*-2*c*. This tool is described in detail in U.S. Pat. No. 8,132,619 that issued in 2012. The detailed operation of the tool is covered at great length in that patent and will not be repeated here. Instead the major components and tool operation of the existing tool will be reviewed below to provide context for understanding the issue with the tool that brought about the improvement to the tool that constitutes the present invention. FIGS. 2*a*-2*c* represent the liner hanger packer assembly and FIGS. 1*a*-1*c* represent the running tool that fits inside the assembly of FIGS. 1*a*-1*c*.

The liner hanger/packer 10 is shown in FIGS. 2*a*-2*c*. It has an expandable slip ring 12 that is separately patented in U.S. Pat. No. 7,607,476 and an adjacent sealing element 14. An upper extension 16 has teeth 18 at an upper end to selectively engage teeth 20 of the running tool 22 for tandem rotation during running in. When assembled for running in, the swage assembly 24 is positioned just above taper 26 above the slip ring 12. The stroker assembly 28 occupies the balance of the upper extension 16 up to teeth 20, during run in. A pup joint 30 has a lower end thread 32 for connection of the liner that is not shown. In operation, the sequence of events is to drill or ream the well with a bit or a reaming shoe at the lower end of the liner and when the desired overlap to an existing tubular is reached, to set the slip ring 12 by expansion resulting from stroking swage assembly 24 a first time. Cementing can then take place with displaced fluids getting past the set slip ring 12 that now bites the existing well tubular that is not shown. After the cementing is completed by the launching of wiper plug 34 as a result of dropping a dart into the wiper plug and pressuring up, the swage assembly 24 is stroked further to expand the sealing element 14 and the running tool 22 is withdrawn.

The major components of the running tool 22 are the stroker assembly 28 that selectively moves the swage assembly 24 after the anchor assembly 36 is engaged. The flapper assembly 38 is engaged to selectively release a flapper 40 to close in preparation for the second stroke of the swage assembly 24 that will then expand the sealing element 14. After the sealing element 14 is set, further pressure buildup breaks a rupture disc 42 in the flapper 40 to avoid pulling a wet string. The stroker assembly is made up of a series of pistons 44, 46 and 48 that are respectively pressured to move downhole through pressure respectively delivered through ports 50, 52 and 54. This can happen when a ball 55 is dropped onto seat 56 and pressure is built up. When that happens, the first event is the setting of the anchor section 36 via ports 58 to stroke a piston 60 that has a lower end connected to slip segments 62. Axial movement of the segments 62 along edge ramps 64 brings the segments 62 radially outwardly into a grip relation to the surrounding pup joint 30 shown in FIG. 2*b*. Once the slip segments 62 get a bite further pressure increase strokes the pistons 44, 46 and 48 and axially advances the swage assembly 24 to expand the slip ring 12 so that the liner is supported and is ready to be cemented. Further pressure increase after the full stroke of the stroker assembly 28 will then blow ball 55 past the seat 56 as a result of the seat 56 shifting to allow it to open up to let ball 55 pass so that the cement can pass into the liner that is not shown and its associated shoe that is also not shown and into the surrounding annulus in the known manner. Blowing ball 55 past the seat 56 also releases the running tool 22 from the liner hanger/packer 10. The displaced fluid can get past the slip ring 12 because at this time the sealing element 14 is not yet expanded. After the cement is pumped through the wiper plug 34 a dart that is not shown is landed in it to launch wiper plug 34 which concludes the cementing operation so that the sealing element 14 can now be set.

The process of expanding the sealing element 14 first requires that the passage 66 be closed with flapper 40 to enable another stroke of the stroker assembly 28 so that the swage assembly can be advanced again for expansion of the sealing element 14. In order to release the flapper 40 to close, the running tool 22 is lifted to release the support lugs 68 into an expanded portion under the slip ring 12 so that on subsequent setting down weight the flapper 40 can be advanced relative to sleeve 70 so that a spring on the flapper 40 can rotate it 90 degrees to a closed position. The rupture disc 42 in the flapper 40 is still intact at this time so that the passage 66 is closed to pressure applied from above in a similar manner as the original closing of this passage at a higher location to set the slip ring 12 by pressuring up on seated ball 55 on seat 56. This time to set the sealing element 14 the barrier to pressure is further downhole at the closed flapper 40 that is sprung to move down onto a seat to retain applied pressure from above.

It should be noted that for the initial movement to set the slip ring 12 the ball 55 landed on seat 56 isolates access ports 72 from applied tubing pressure. Pressure on ports 58 above the seated ball 55 moves the piston 60 and displaces fluid through then open ports 72. However, with flapper 40 in the closed position to get another stroke of stroker assembly 28 so that the swage assembly 24 can again advance requires that the anchor assembly 36 again become operable. With ball 55 shifting seat 56 to allow it to pass through, it can be seen that the ports 72 need to be blocked off so that pressure against the closed flapper 40 will be directed as before to ports 58 for actuation of the anchor assembly 36. Thus the same setting down weight movement with lugs 68 extended also results in upper end 74 is positioned over the ports 72 from the setting down weight that has moved the ports 72 while the sleeve 70 is supported off landed lugs 68. At this time applied pressure above the flapper 40 that is now closed goes into ports 58 to set the anchor assembly 36 and into ports 50 and 52 to operate the stroker assembly 28 in the manner described for expansion of the slip ring 12 but this second stroke now expands the sealing element 14. When that is done further pressure buildup blows the rupture disc 42 in the closed flapper 40 and the running tool 22 is ready to be removed.

While the description above is a slightly abridged description of the operation of this tool, those skilled in the art can find all the remaining details in the description of the preferred embodiment of U.S. Pat. No. 8,132,619 that is fully incorporated herein by reference as if fully set forth. The above description of the existing tool is intended to provide context to explaining the problem with the existing tool and in so doing the present invention that deals with and solves this problem.

The problem has been the removal movement of the running tool 22 can occur at a fast enough speed such that fluid trying to get through the tool where rupture disc 42 has been ruptured creates a back pressure above the flapper 40 that continues to be in the closed position. This back pressure then communicates with ports 58 that remain open at the same time that the set down movements described above in order to set the sealing element 14 have sleeve 70 blocking ports 72. The generated backpressure acting on ports 58 urges the piston 60 to advance slips 62 along inclined ramps 64 so that a bite is obtained against the casing pup joint 30 that surrounds the slips 62 and the running tool 22 anchors and cannot be removed. In the past when this occurred a release of the slips 62 by forcing them to ride back down ramps 64 was accomplished with another tool feature that allowed rotation of the running tool 22 to mechanically retract the slips 62 with the aid of spring 76 shown in FIG. 1B. The potential problem with this solution is that if there is significant deviation in the wellbore, the effect of rotation at the surface may be negligible at the desired location of the release threads. The solution for all applications and the subject of the present invention is adding an ability to reopen the ports 72 after the sealing element 14 is expanded and by doing so putting the anchoring assembly 36 in pressure balance to passage 66 above the flapper 40 that is in the closed position with the rupture disc 42 in it in the ruptured condition. This pressure balance comes from ports 58 and 72 open at the same time that the running tool 22 is lifted. In this condition, any backpressure raised due to movement of running tool 22 inducing fluid flow through the broken rupture disc 42 will not create a net force on the slips 62 and will also allow the spring 76 to maintain a net force on the piston 60 that in turn will pull the slips 62 back down the inclined edge ramps 64 so that the slips will not bite the pup joint 30 so that the running tool 22 can be removed without mechanical resistance from the anchor assembly 36.

Those skilled in the art will more readily appreciate these and other aspects of the present invention from a review of the detailed description of the invention and the associated drawings while understanding that the full scope of the invention is to be found in the appended claims.

SUMMARY OF THE INVENTION

A liner hanger/packer apparatus operates by sequential expansion of a slip ring and then a sealing element. The hanger slips are set by pressure on a seated ball actuating anchor slips to grip followed by a stroker assembly and a swage making a first movement. The ball seat is defeated and the liner is cemented. A pickup force extends landing dogs so that a subsequent set down force releases a flapper to close and closes off fluid ports associated with the anchor slips so that pressure on the closed flapper sets the anchor and strokes the swage a second stroke to set the sealing element. A rupture disc breaks in the flapper after further relative movement of mandrel components to open the fluid displacement ports so that the anchor is in pressure balance to backpressure developed from fluid moving through the now broken disc as the running tool is removed.

DETAILED DESCRIPTION OF THE PREFERRED EMBODIMENT

Figure 1A:
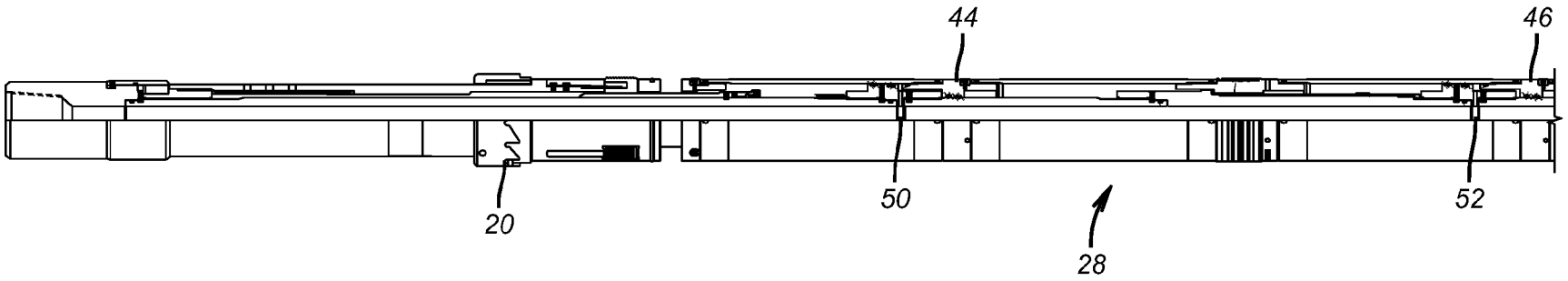
(PRIOR ART) FIG. 1a
FIGS. 1*a*-1*c* are a part section through the prior running tool essentially in the run in condition.
Figure 2A:
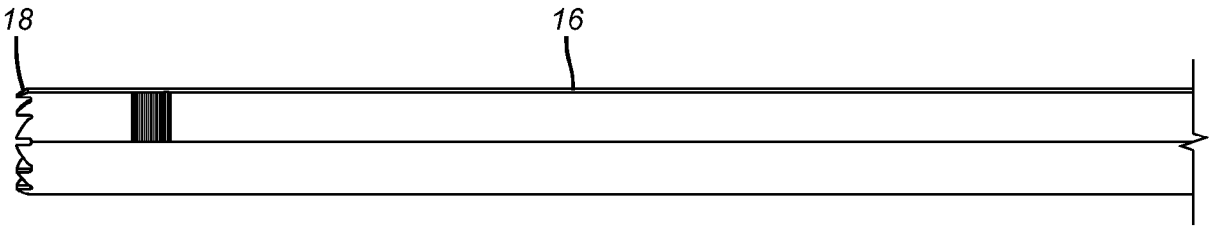
(PRIOR ART) FIG. 2a
FIGS. 2*a*-2*c* are a part section through the prior art hanger/packer set by expansion using the running tool of FIGS. 1*a*-1*c;*
Figure 1B:
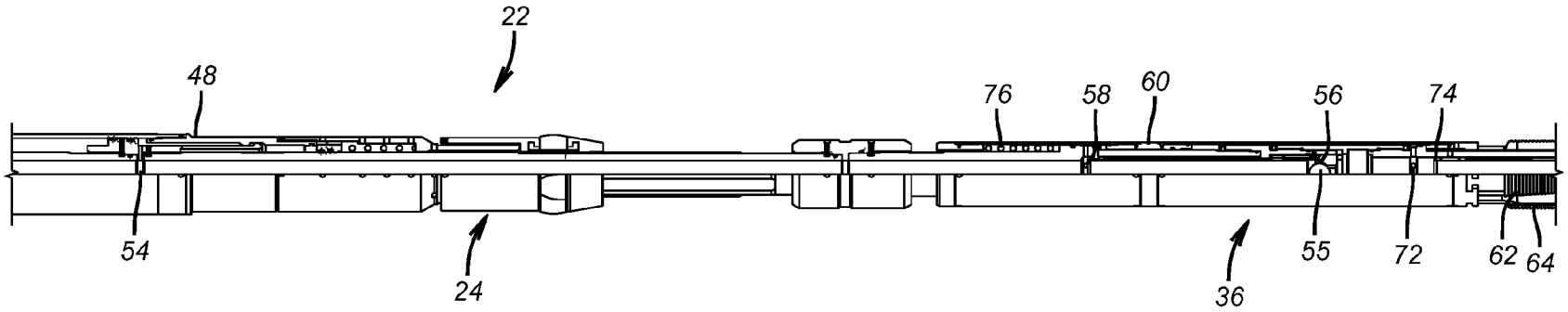
(PRIOR ART) FIG. 1b
Figure 2B:
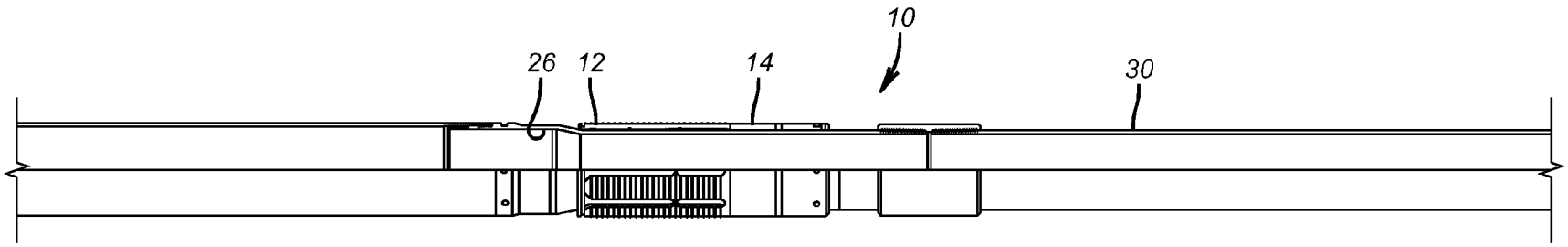
(PRIOR ART) FIG. 2b
Figure 1C:
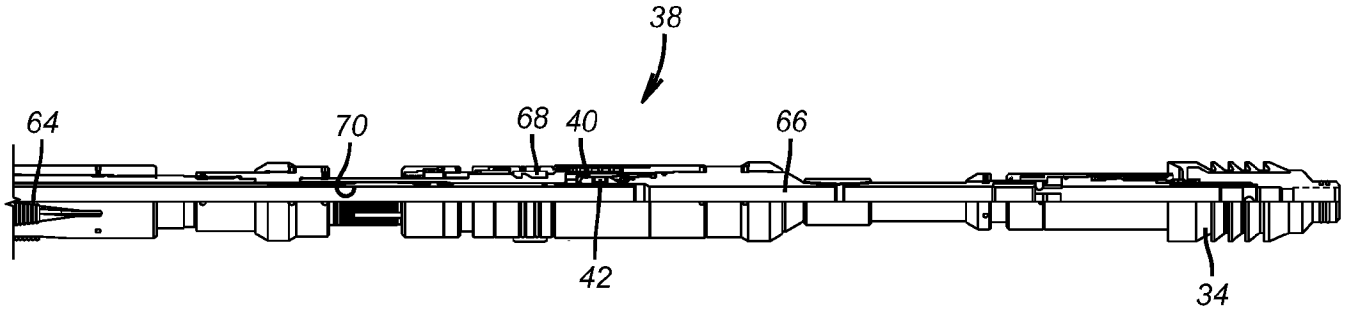
(PRIOR ART) FIG. 1c
Figure 2C:
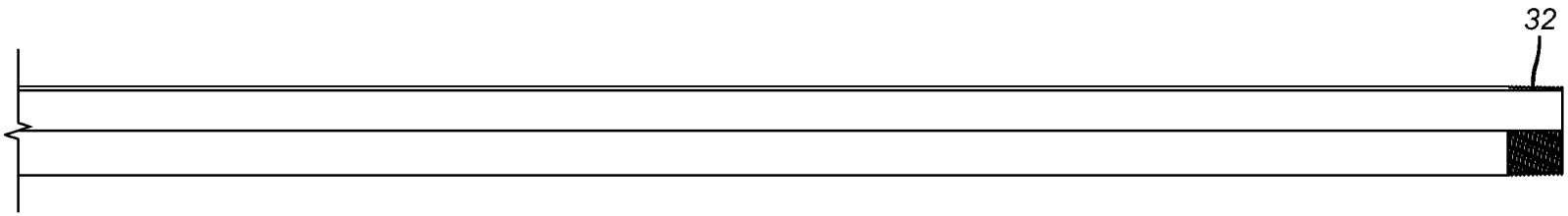
(PRIOR ART) FIG. 2c
Figure 3A:
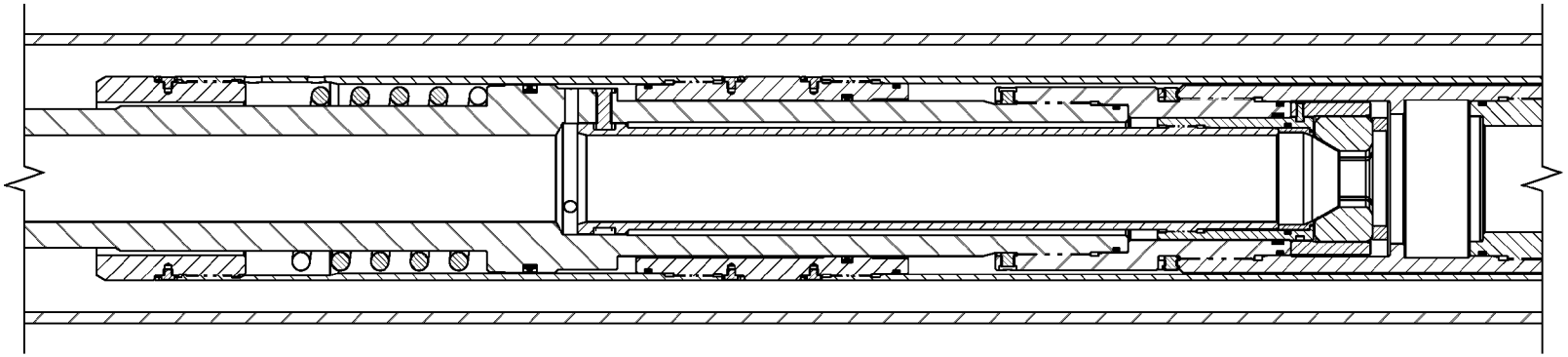
FIGS. 3*a*-3*c* are a section view of the tool of the present invention shown in the run in position.
Figure 3B:
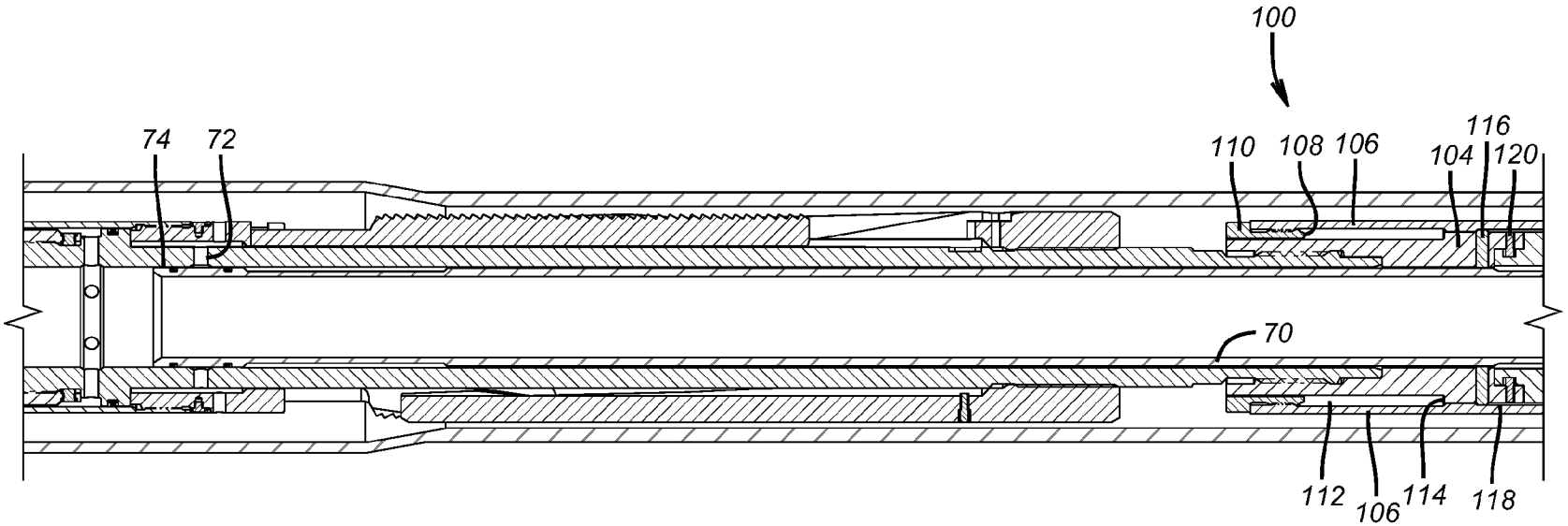
Figure 3C:
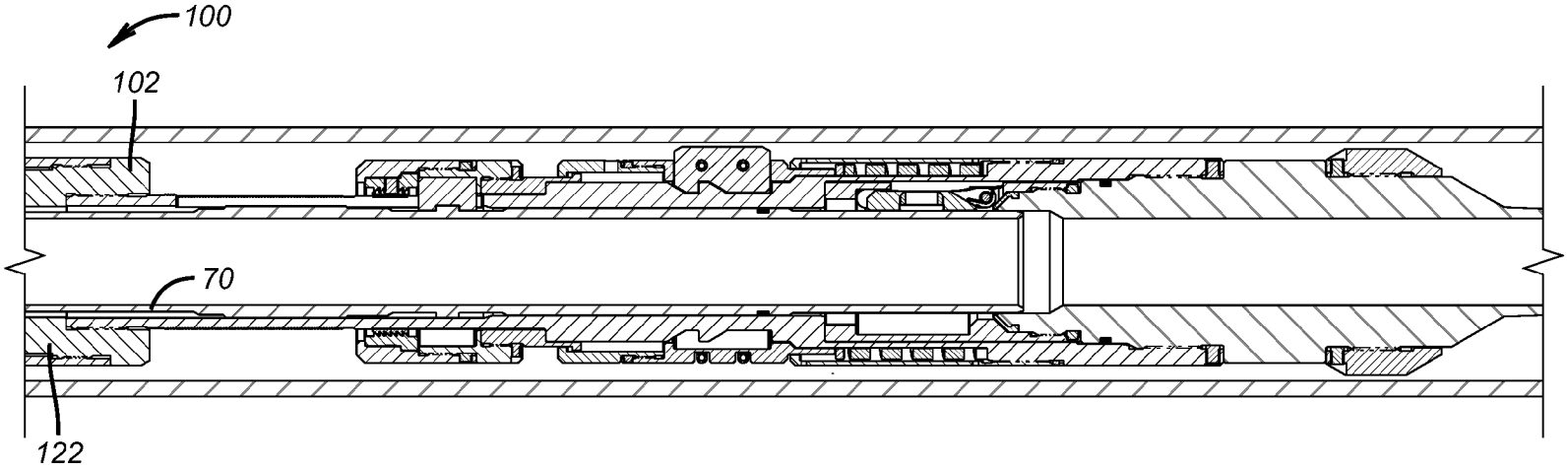
Figure 4A:
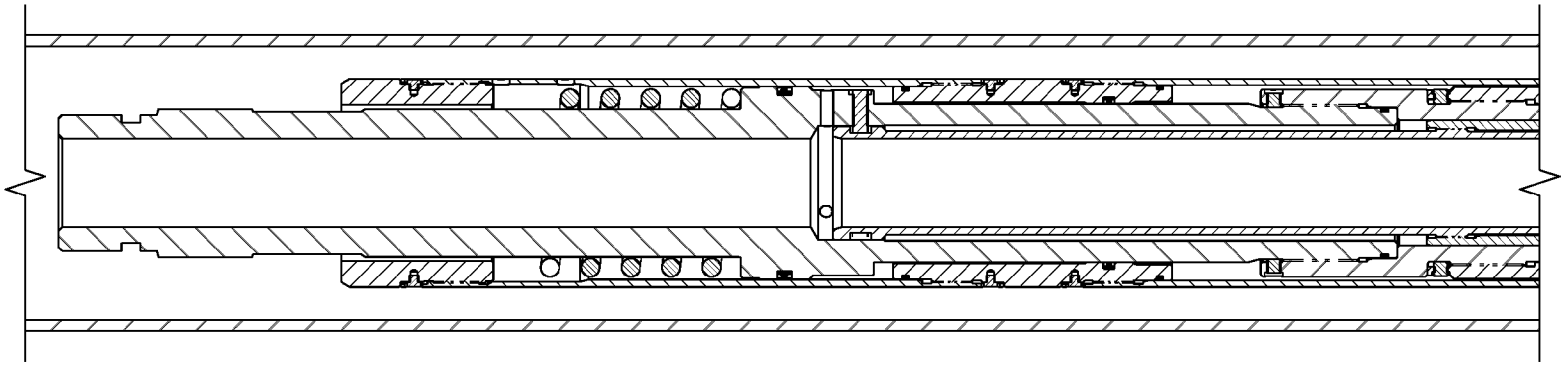
FIGS. 4*a*-4*c* are a section view of the tool of the present invention shown in the position after the slip ring is expanded.
Figure 5A:
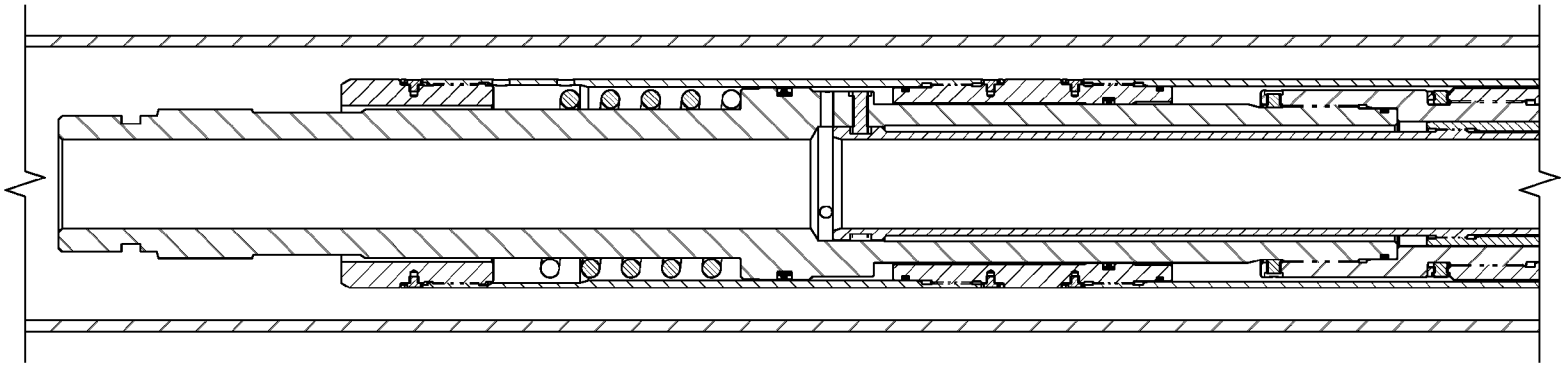
FIGS. 5*a*-5*c* are a section view of the tool of the present invention shown in the position after picking up to extend the landing dogs.
Figure 4B:
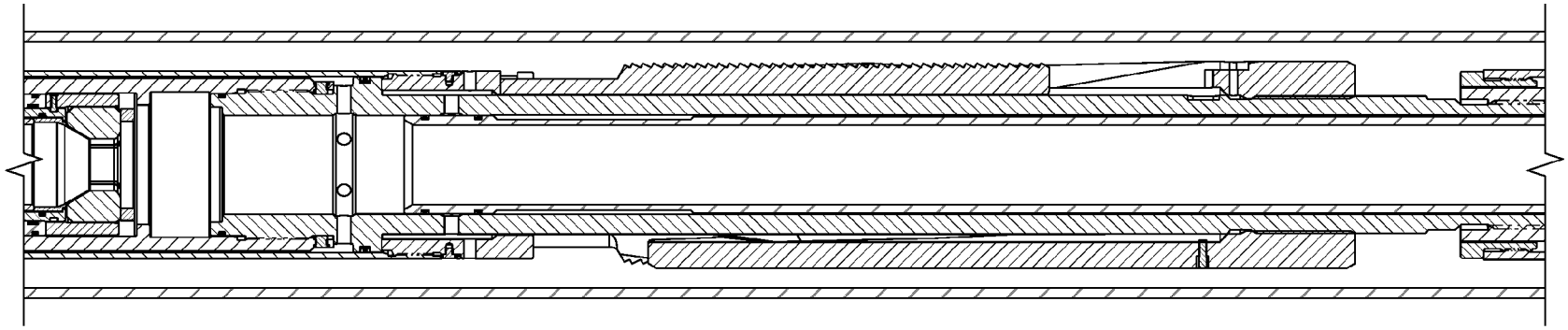
Figure 5B:
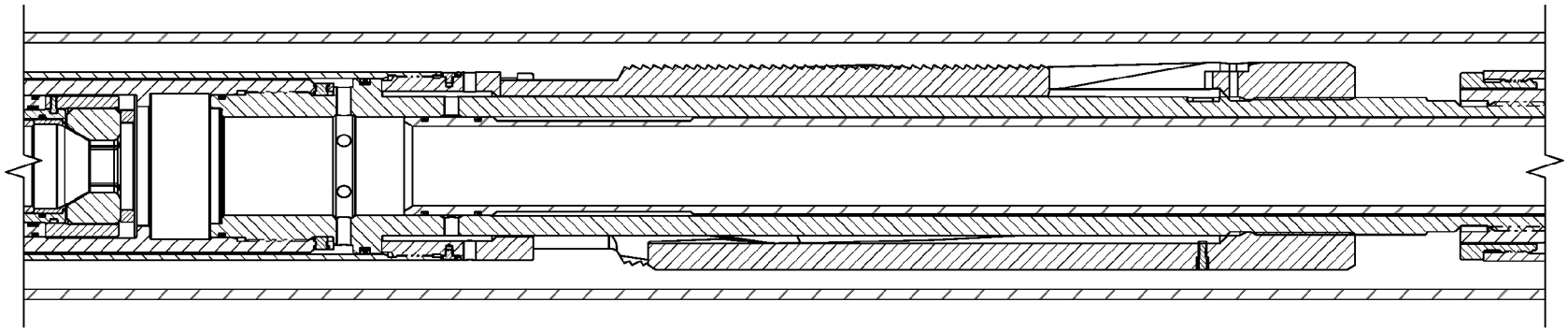
Figure 4C:
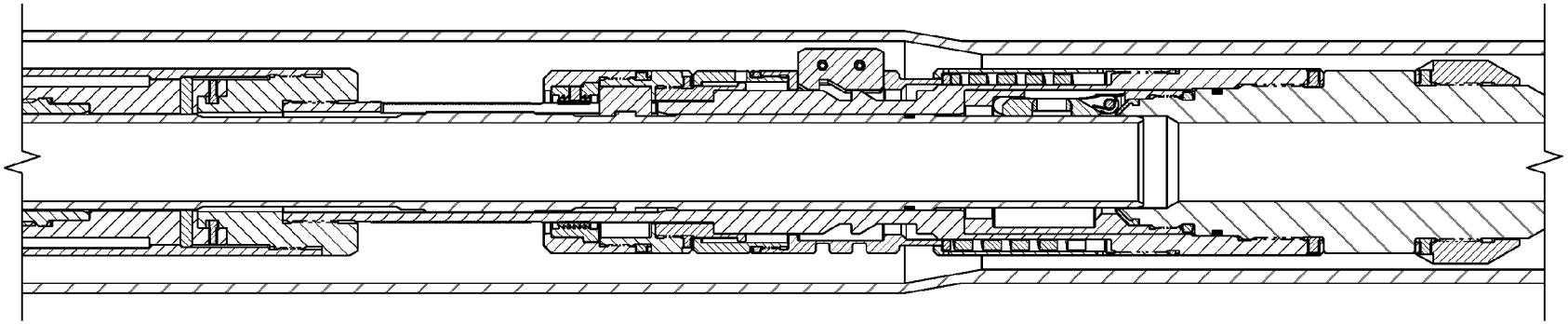
Figure 5C:
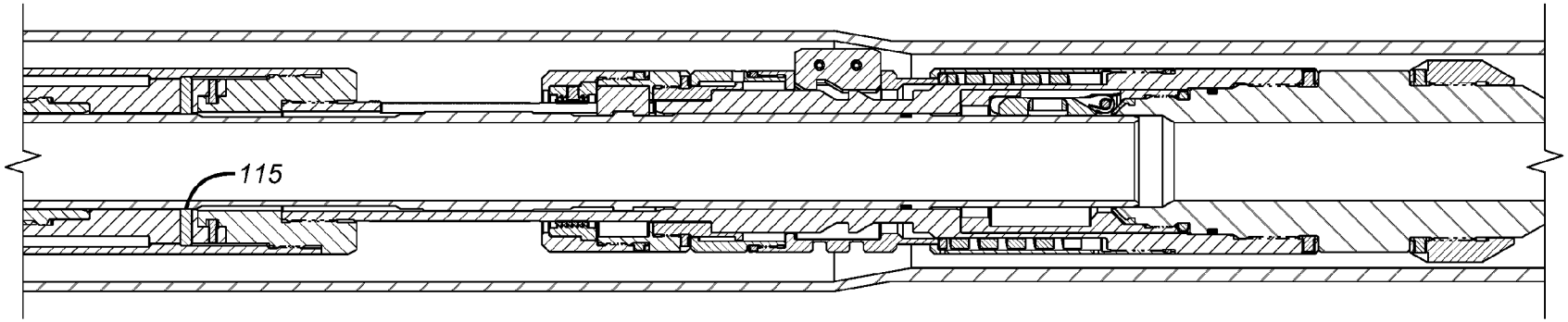
Figure 7A:
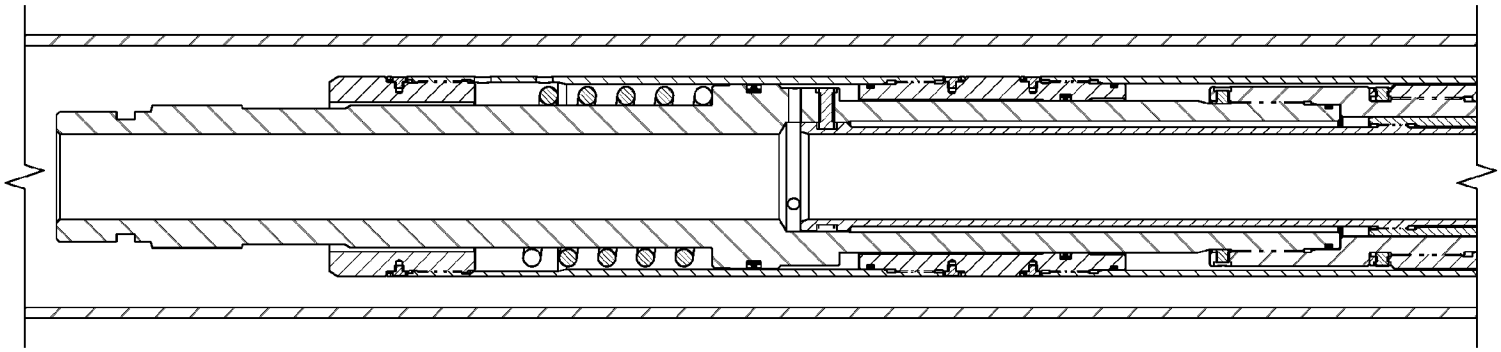
FIGS. 7*a*-7*c* are a section view of the tool of the present invention shown in the position with additional pressure applied after setting the sealing element to expose pressure balance ports for the anchor slips so that removal of the running tool cannot actuate the anchor slips.

FIGS. 3*b* and 3*c* illustrate the new structure that is part of the present invention. The breakaway assembly 100 has a lower component 102 that overlaps upper component 104 with a sleeve 106 that has a radial shoulder 108 on end ring 110. The upper component 104 has and external recess 112 that forms a radial surface 114 that acts as a travel stop for the radial shoulder 108 when relative movement between components 102 and 104 begins. A dog 116 is supported at one end 115 (see FIG. 5*c*) by sleeve 70 with the dog 116 extending through an opening in upper component 104 and then into an undercut 118 on sleeve 106. As long as the dog 116 which in the preferred case is a pin is supported by sleeve 70 at end 115 there can be no relative movement between the components 102 and 104 and no way to break the shear pin 120 that holds the components 102 and 104 together. The lower component 102 has an extending portion 122 that is tied into sleeve such that movement of the lower component 102 relative to the upper component 104 that is held stationary as part of the mandrel for the running tool 22 will have the result of moving sleeve 70 downhole to the point where its upper end 74 will expose the ports 72 so that pulling out the running tool 22 will not actuate the anchor slips 62 to slide radially outwardly on sloping end ramps 64 and impede removal of the running tool 22. Note that in the FIG. 3*b* position these movements have not yet occurred.

Figure 6A:
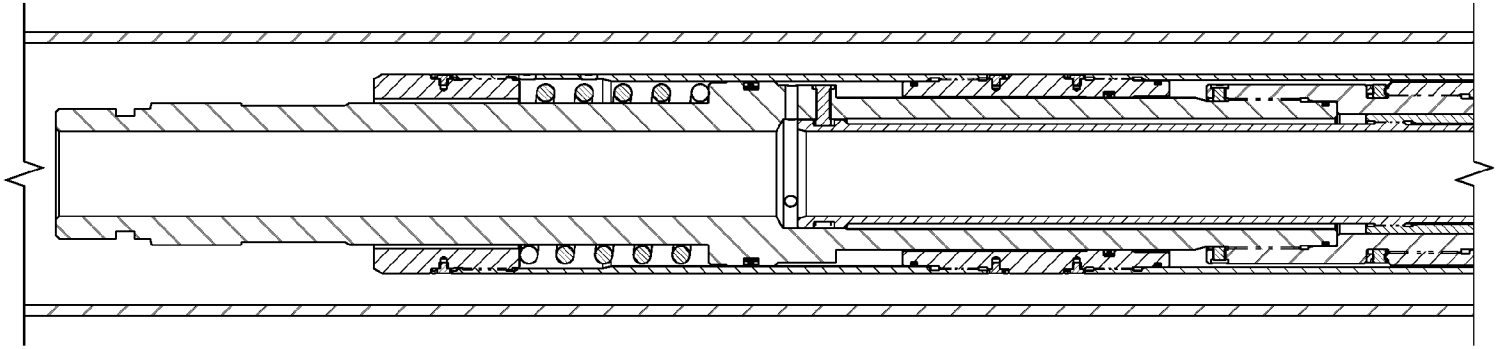
FIGS. 6*a*-6*c* are a section view of the tool of the present invention shown in the position after setting down weight to allow the flapper to close and pressure then built up to set the sealing element of the liner hanger/packer.
Figure 6B:
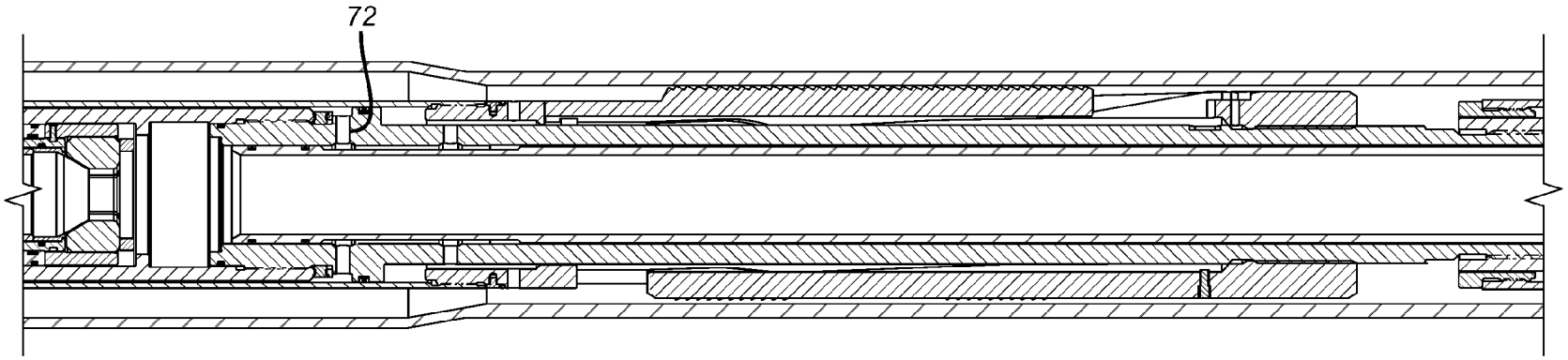
Figure 7B:
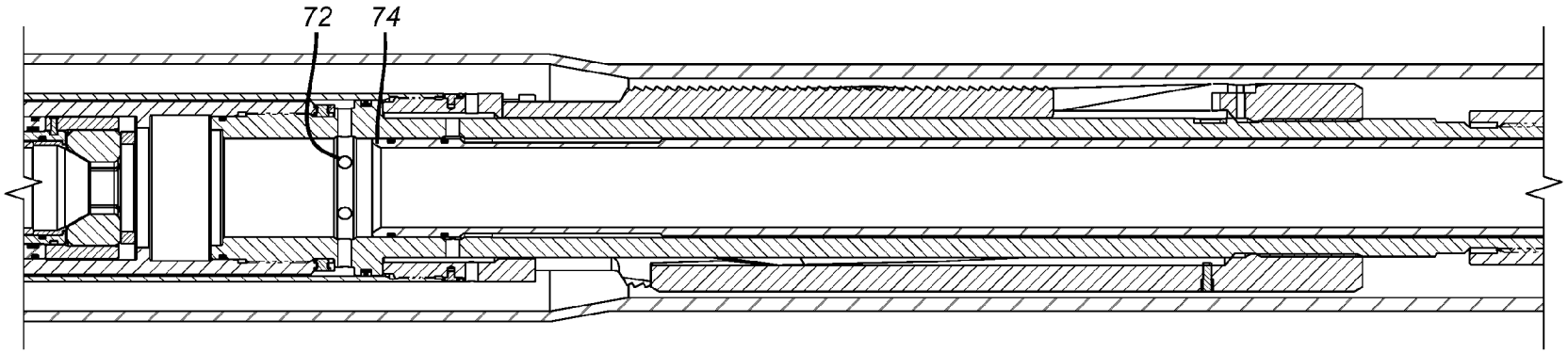
Figure 6C:
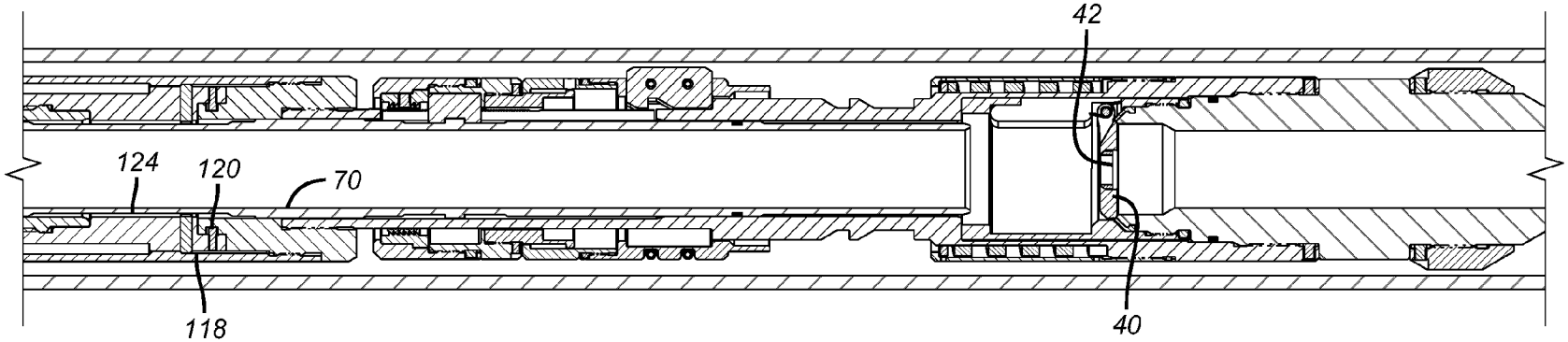
Figure 7C:
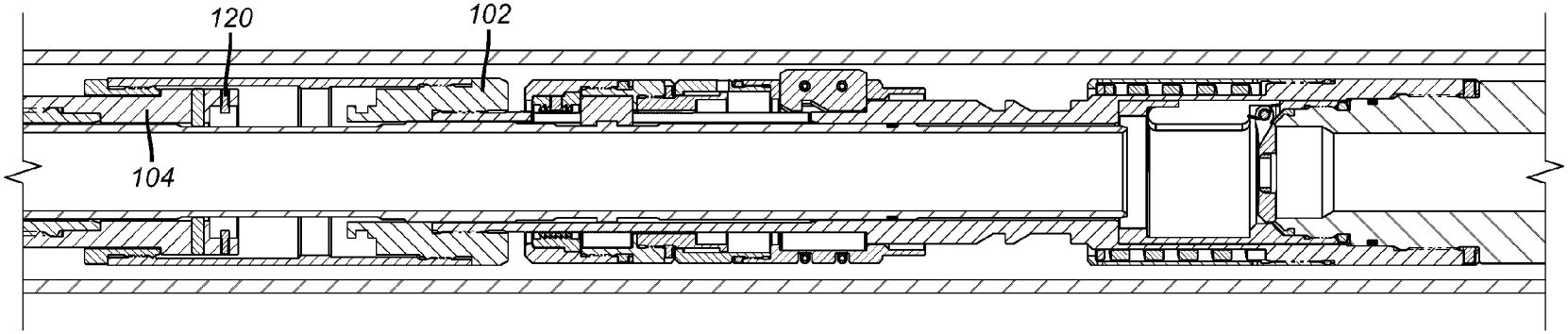

The general tool operation has been described above and will not be repeated here except to note the differences in the operation of the revised tool during the operation of expanding the sealing element 14. As before the flapper 40 that has a rupture disc 42 is allowed to assume the closed position of FIG. 6*c*. However, the setting down weight that allowed the flapper 40 to close also positions a recess 124 on sleeve 70 at dog 116 that in effect allows the dog 116 to back out of undercut 118, which in effect disables the dog 116 from holding together the components 102 and 104. At this time as shown in FIG. 6*c* it is only the shear pin 120 that holds together components 102 and 104. As before, pressure is built up against the flapper 40 in the closed position with sleeve 70 covering ports 72 as shown in FIG. 6*b*. The shear pin 120 is set a value that is high enough to make sure that it doesn't break at pressures that will set the anchor assembly 36 and activate the stroker assembly 28 to move the swage assembly 24 in the manner described before for the setting of the sealing element 14. However, after enough pressure is applied to ensure the expansion of the sealing element 14 in the manner described above the shear pin 120 breaks due to differing opposed piston areas on components 102 and 104 that tends to separate them. Such separation takes in tandem the sleeve 70 and the lower component 102 so that once again the ports 72 are exposed as the upper end 74 of the sleeve 70 is forced downhole past ports 72 while the running tool 22 is held firm to keep the upper component 104 from moving. As seen in FIGS. 7*b* and 7*c* the shear pin 120 has been broken and lower component 102 has moved downhole in tandem with sleeve 70 so that top end 74 is no longer covering ports 72. As mentioned above with ports 58 and 72 open there is no net force from backpressure generated by lifting the running tool 22 and fluid rushing through the broken rupture disc 42 in flapper 40 as tool 22 is raised out of the wellbore.

Those skilled in the art will appreciate that with the addition of the breakaway assembly 100 to the original tool described in the background of the invention that the risk of extension of the slips 62 during tool 22 removal is eliminated because the piston 60 that normally drives the anchor slips 62 has open ports 58 and 72 as the tool 22 is raised. Even a pressure developed by fluid trying to get through the broken rupture disc 42 will not apply a net force to the slips 62 and the return spring 76 will add a retraction force to slips 62. There will therefore be no need to rotate to retract the slips 62 which can be problematic in deviated wells.

In essence the resulting assembly presents a slip ring 12 that is expanded with an initial stroke of an expander 24 driven by pressure on a ball 55 seated on a seat 56. The seated ball isolates ports 72 from surface pressure that sets the slip ring 12. After setting the slip ring 12 the seat is translated so that ball 55 is released and the liner is cemented. After cementing the passage 66 is again open and needs to be closed to pressure up for another stroke of the swage assembly 24. Additionally since the seat 56 is no longer serviceable and ports 72 are exposed, there needs to be a way to close the ports 72 and the passage 66 to stroke the swage assembly 24 on more time to expand the sealing element 14. This is accomplished with a pickup and set down movement to extend dogs 68 which then allow the flapper 40 to close while causing relative movement to cover ports 72. Now with pressure applied the anchor slips 62 extend and the swage assembly 24 is stroked. Further pressure increase above setting the sealing element 14 separates the breakaway assembly 100 to move sleeve 70 back away from ports 72 so that a lifting force to the running tool 22 will not actuate the slips 62 as opposed ends of the driving piston 60 are open to passage 66 and a return spring 76 acts to pull the slips 62 back on their inclined guides 64. In short, the anchoring assembly is unaffected by backpressure caused by fluid trying to get through the broken rupture disc 42 as the running tool is raised at the desired speed. The anchor assembly is in pressure balance to pressure in passage 66 above the broken rupture disc 42.

It should be noted that alternatives to the rupture disc 42 in a flapper can be used to open the passage to flow such as a pressure responsive sleeve that opens a port in a bypass passage around the flapper can be used in the alternative.

The above description is illustrative of the preferred embodiment and many modifications may be made by those skilled in the art without departing from the invention whose scope is to be determined from the literal and equivalent scope of the claims below.

I claim:

1. A running tool for delivery and sequential expansion into an existing tubular of a hanger mounted to a tubular string followed by expansion of a sealing assembly mounted to the tubular string, comprising:

a mandrel having an upper end and a passage therethrough;

an anchor assembly on said mandrel selectively engageable to the tubular string;

a stroker assembly on said mandrel to selectively drive a swage assembly into the tubular string while said anchor assembly selectively grips said tubular string using pressure in said passage;

said passage selectively closed at a first and at a second location, said anchor assembly in fluid communication with said passage on opposed sides of said first location with at least one upper port and at least one lower port, said second location is further from said upper end of said mandrel than said first location;

said anchor assembly actuated once with pressure in said passage delivered to said upper port from said upper end of said mandrel with said passage closed at said first location; and said anchor assembly actuated another time with pressure in said passage delivered to said upper port from said upper end of said mandrel with said passage closed at a second location and open at said first location and with said lower port selectively closed, said lower port subsequently opened for removal of the running tool from the tubular string with said upper and lower ports open.

2. The tool of claim 1, wherein:

said anchor assembly is in pressure balance to said passage when said upper and lower ports are open and said passage is open at said first location.

3. The tool of claim 1, wherein:

said passage further comprising a sleeve selectively positioned for covering and exposing said lower port.

4. The tool of claim 3, wherein:

said sleeve movable to uncover said lower ports with said passage pressured to said lower location to a level that at least actuates said anchor and stroker assemblies.

5. The tool of claim 4, wherein:

said mandrel further comprises a breakaway connection that separates at a predetermined pressure in said passage to shift said sleeve away from said lower ports.

6. The tool of claim 5, wherein:

said breakaway connection comprises selectively locked segments.

7. The tool of claim 6, wherein:

said selective locking comprising multiple locking members.

8. The tool of claim 7, wherein:

said multiple locking members comprising at least one locking dog and at least one shearable member.

9. The tool of claim 8, wherein:

said dog defeated with mandrel movement that closes said passage at said second location.

10. The tool of claim 9, wherein:

said shearable member is initially subject to shearing by defeat of said locking dog by removal of support therefore as a result of said mandrel movement.

11. The tool of claim 10, wherein:

one of said breakaway segments is secured to said sleeve for tandem movement.

12. The tool of claim 5, wherein:

said breakaway connection further comprising opposed differing piston areas to create a net force from pressure to said lower location.

13. The tool of claim 8, wherein:

said shearable member fails at a passage pressure higher than a pressure that actuates said anchor and stroker assemblies.

14. The tool of claim 13, wherein:

said mandrel movement that defeats said locking dog releases a flapper to close said passage at said second location.

15. The tool of claim 14, wherein:

said flapper comprises a rupture disc that blows at a passage pressure higher than the pressure that fails said shearable member.

16. The tool of claim 3, wherein:

said sleeve is moved to cover said lower port after actuation of said anchor and stroker assemblies with said passage obstructed at said first location.

17. The tool of claim 16, wherein:

said sleeve is selectively supported by at least one support dog selectively engaging the tubular string to permit relative mandrel movement for positioning said lower port behind said sleeve.

18. The tool of claim 1, wherein:

said passage is selectively closed at said first location with an object landed on a selectively movable seat, whereupon pressure against said ball on said seat to a predetermined level moves said seat to allow said ball to pass therethrough.

19. A running tool for delivery and sequential expansion into an existing tubular of a hanger mounted to a tubular string followed by expansion of a sealing assembly mounted to the tubular string, comprising:

a mandrel having an upper end and a passage therethrough;

an anchor assembly on said mandrel selectively engageable to the tubular string;

a stroker assembly on said mandrel to selectively drive a swage assembly into the tubular string while said anchor assembly selectively grips said tubular string using pressure in said passage;

said anchor assembly in selective pressure balance to pressure in said passage through spaced apart upper and lower ports communicating with said passage; and said anchor assembly operable with said ports open and said passage blocked between said ports, said anchor assembly further operable with said lower port closed and said passage pressured to a second location further from said mandrel upper end than said lower port, said lower port opened after said anchor assembly is further operated.

20. The tool of claim 19, wherein:

said mandrel comprising a breakaway connection having segments that separate with one of said segments moving a sleeve away from said lower port after said anchor assembly is further operated.

21. The tool of claim 20, wherein:

said second location is selectively closed with a flapper having a selectively opened bypass associated therewith, said rupture disc breaking at a higher passage pressure than that pressure that caused movement of said sleeve by separation of said breakaway connection so that said anchor assembly is in pressure balance to fluid pressure in said passage generated from flow through said broken rupture disc upon removal of the running tool from the tubular string.

* * * * *